US009121150B2

(12) United States Patent
Bauer

(10) Patent No.: US 9,121,150 B2
(45) Date of Patent: Sep. 1, 2015

(54) CONVEYANCE SYSTEM

(75) Inventor: Joel R. Bauer, Sycamore, IL (US)

(73) Assignee: Federal Signal Corporation, Oak Brook, IL (US)

( * ) Notice: Subject to any disclaimer, the term of this patent is extended or adjusted under 35 U.S.C. 154(b) by 1115 days.

(21) Appl. No.: 13/159,036

(22) Filed: Jun. 13, 2011

(65) Prior Publication Data

US 2011/0303240 A1 Dec. 15, 2011

Related U.S. Application Data

(60) Provisional application No. 61/397,644, filed on Jun. 14, 2010.

(51) Int. Cl.
*E01H 1/04* (2006.01)

(52) U.S. Cl.
CPC ..... *E01H 1/042* (2013.01)

(58) Field of Classification Search
CPC ..... E01H 1/042
USPC ..... 15/78, 82–84, 99; 198/860.1, 841
See application file for complete search history.

(56) References Cited

U.S. PATENT DOCUMENTS 3,554,360 A * 1/1971 Bildsoe ..... 198/833
3,559,894 A 2/1971 Murray et al.
4,106,270 A 8/1978 Weigand et al.
4,164,820 A 8/1979 Krickovich
4,171,551 A 10/1979 Hildebrand et al.
4,222,141 A 9/1980 Kieft et al.
4,271,661 A 6/1981 deBuhr
4,405,089 A 9/1983 Taylor
4,457,044 A 7/1984 Erdman et al.
5,054,152 A 10/1991 Hulicsko
5,060,334 A 10/1991 Strauser et al.
5,251,652 A 10/1993 Strauser et al.
5,361,441 A 11/1994 Williamson
5,596,784 A 1/1997 Tolmachoff
5,797,203 A 8/1998 Vanderlinden
6,052,865 A 4/2000 Schwarze et al.
6,070,290 A 6/2000 Schwarze et al.
6,142,290 A 11/2000 Tagliaferri
6,195,837 B1 3/2001 Vanderlinden
6,651,418 B1 11/2003 McClure et al.
6,877,180 B2 4/2005 Wilmo et al.
6,948,213 B2 9/2005 Kim (Continued)

OTHER PUBLICATIONS

"Schwarze M6000 Mechanical Broom Sweeper," 4 pages (published before Jun. 13, 2011).

(Continued)

*Primary Examiner* — Laura C Guidotti
(74) *Attorney, Agent, or Firm* — Merchant & Gould P.C.

(57) ABSTRACT

This disclosure relates to street sweepers and interchangeable conveyor modules for use with street sweepers that are interchangeable. A first conveyor module is provided that is mountable to the conveyor support structure of the vehicle wherein the conveyor is configured to transport debris from the broom assembly to the hopper on a continuous belt having paddles. A second conveyor module is also provided that is mountable to the vehicle structure wherein the second conveyor is a squeegee type conveyor. The first conveyor module and the second conveyor module are interchangeable on the street sweeping vehicle. Because the size envelope and attachment points and mechanisms are common, the two modules can be interchanged at will.

2 Claims, 22 Drawing Sheets

(56) References Cited

U.S. PATENT DOCUMENTS

| | | | |
|---|---|---|---|
| 7,086,118 | B2 | 8/2006 | Engel et al. |
| 7,150,062 | B2 | 12/2006 | Charky et al. |
| 7,159,706 | B2 | 1/2007 | Wilmo et al. |
| 7,165,628 | B2 | 1/2007 | Taylor et al. |
| 7,281,296 | B2 | 10/2007 | Strauser |
| 7,441,303 | B2 | 10/2008 | Adair et al. |
| 7,621,018 | B2 | 11/2009 | Libhart |
| 7,996,955 | B2 | 8/2011 | Byczynski |
| 2003/0229957 | A1 | 12/2003 | Skinner et al. |
| 2004/0045585 | A1 | 3/2004 | Wilmo et al. |
| 2005/0060834 | A1 | 3/2005 | Strauser |
| 2005/0194235 | A1 | 9/2005 | Wilmo et al. |
| 2005/0194236 | A1 | 9/2005 | Wilmo et al. |
| 2006/0249357 | A1 | 11/2006 | Wilmo et al. |
| 2009/0013496 | A1 | 1/2009 | Byczynski |

OTHER PUBLICATIONS

"Stewart-Amos Sweeper Company Starfire S-5," 2 pages (published Jun. 2009).

"Sweeping Never Looked So Good, Allianz Johnston MS350 and MT350," 10 pages (2007).

* cited by examiner

CONVEYANCE SYSTEM

CROSS REFERENCE TO RELATED APPLICATIONS

This application claims the benefit of U.S. Provisional Patent Application Ser. No. 61/397,644, filed Jun. 14, 2010, which application is hereby incorporated by reference in its entirety.

TECHNICAL FIELD

This disclosure relates to street sweeping vehicles, and in particular, interchangeable conveyor modules for street sweepers.

BACKGROUND

Mobile street sweepers are commonly employed to remove debris from streets and other flat surfaces, such as parking lots and runways. These types of sweepers typically employ a main broom that moves debris from the surface to be cleaned onto a conveyor assembly. One type of conveyor assembly used for this purpose is a belt type assembly wherein the conveyor comprises a continuous belt having paddles that transport the debris up to a hopper on the sweeper vehicle. Another type of conveyor assembly is a squeegee type assembly wherein the debris is transported against a wear plate via paddles up to the hopper. Typically, street sweeping vehicles employing conveyors are configured and built to accommodate only one specific type of conveyor with no ability to easily reconfigure the vehicle after manufacture. Improvements are desired.

SUMMARY

This disclosure relates to street sweepers and interchangeable conveyor modules for use with street sweepers. In one embodiment, a street sweeping vehicle is provided having a vehicle structure, a hopper, a conveyor support structure mounted to the vehicle structure, and a broom assembly also mounted to the conveyor support structure. A first conveyor module is provided that is mountable to the conveyor support structure wherein the conveyor is a belt type conveyor configured to transport debris from the broom assembly to the hopper. A second conveyor module is also provided that is mountable to the vehicle structure wherein the second conveyor is a squeegee type conveyor. The first conveyor module and the second conveyor module are interchangeable on the street sweeping vehicle. This interchangeability can be further enhanced by providing multiple mounting locations for the broom assembly on the support structure to aid in ideally locating broom with respect to the modules. In such an embodiment, the size envelope, attachment points and mechanisms are common thereby allowing the two modules to be interchanged at will. The squeegee type conveyor modules of this disclosure can also be provided with multiple wear plates having edge patterns, and with fasteners that are below the wear plates so that the fasteners do not interfere with the contact between squeegee paddles and the wear plate top surface.

DETAILED DESCRIPTION

Figure 1:
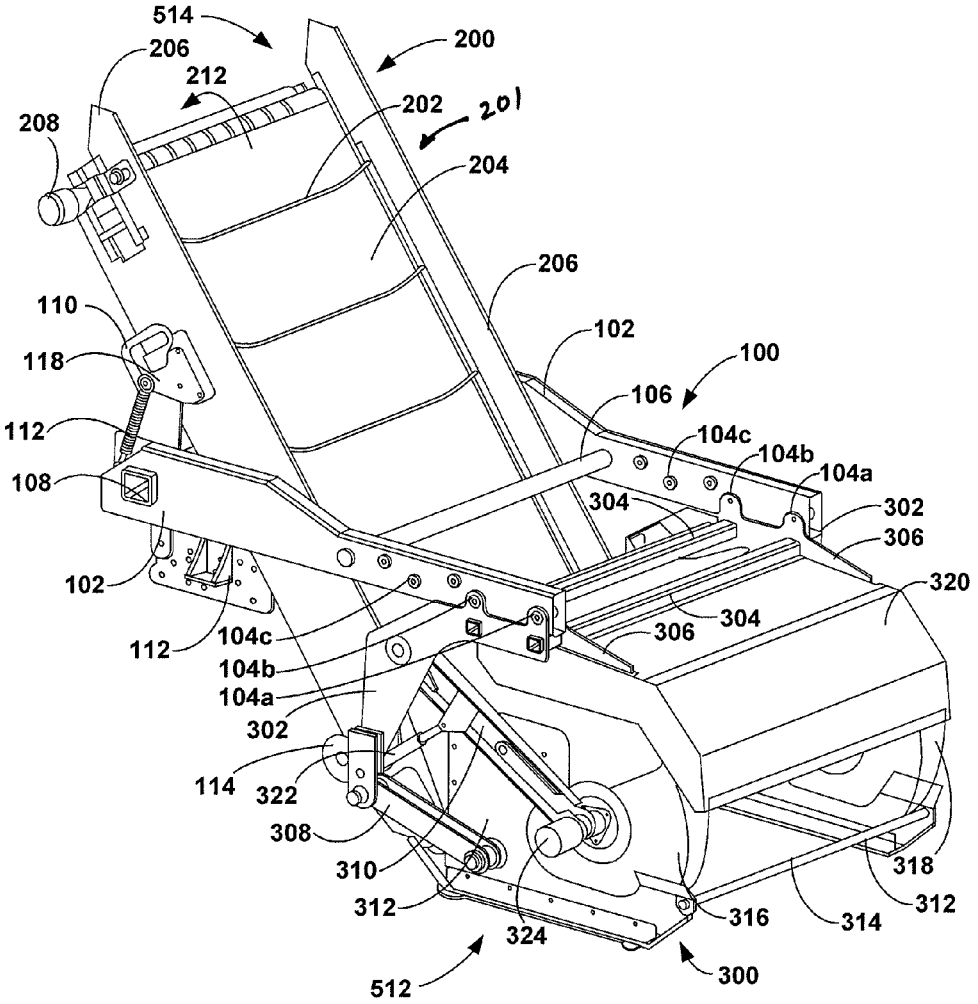
FIG. 1 is a perspective view of a first embodiment of a conveyor module.
Figure 2:
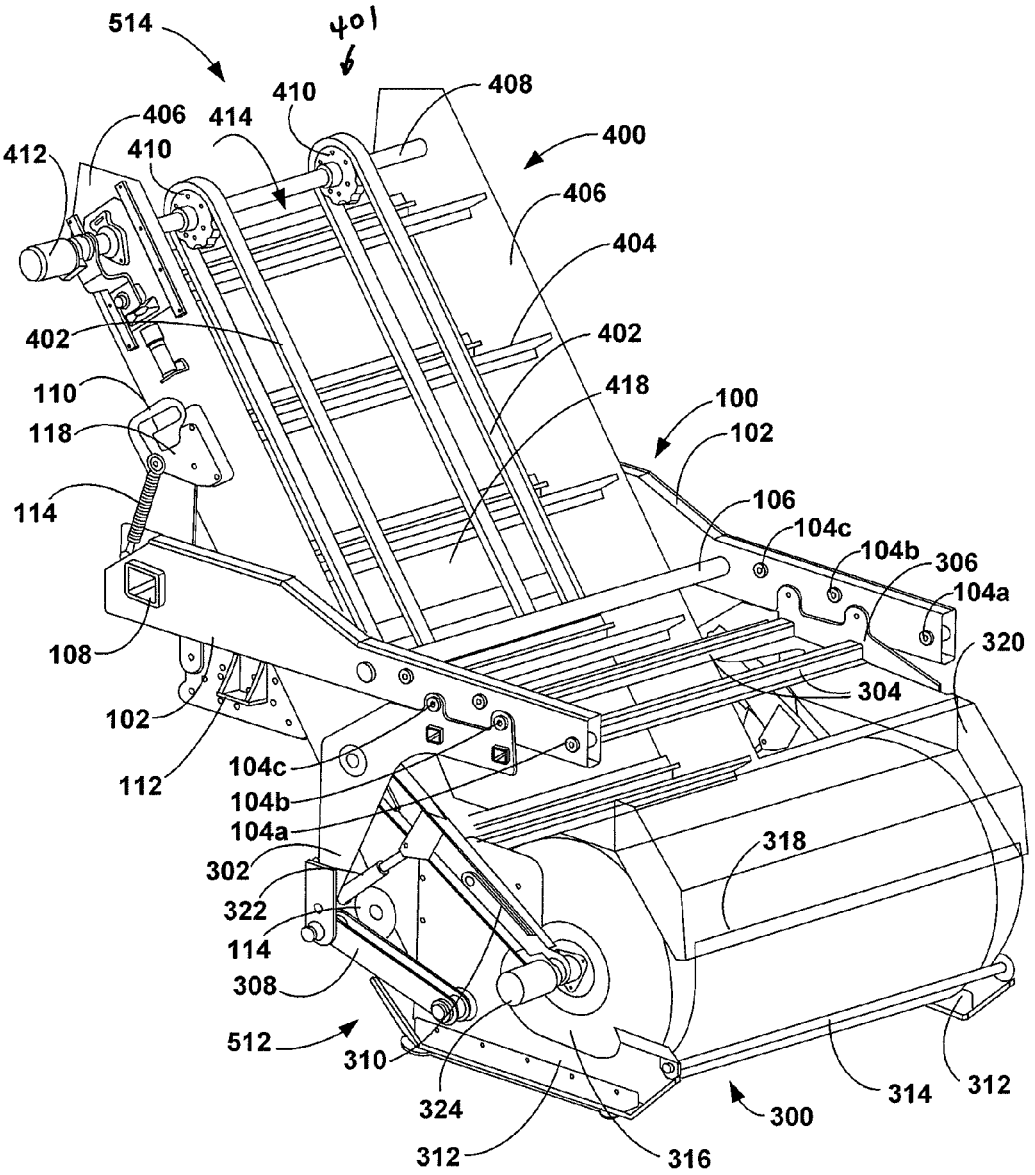
FIG. 2 is a perspective view of a second embodiment of a conveyor module.

Referring to FIGS. 1 and 2, a support structure 100 is shown. Support structure 100 is for providing structural support for the conveyor modules 200 (FIG. 1), 400 (FIG. 2), and the broom module 300 (FIGS. 1 and 2). The conveyor 200 and broom 300 modules are discussed in detail later. Support structure 100 is configured to be attached to a street sweeping vehicle 500 (FIG. 3) via cross-beam 108 and brackets 112. As shown, support structure 100 includes a pair of support arms 102 that are secured together by cross-member 106 and by cross-beam 108. Each support arm 102 includes connection points 104*a*, 104*b*, and 104*c* that are used to support the broom module 300. Multiple connection points 104*a*, 104*b*, 104*c* are provided to allow the broom module 300 to be mounted in different locations depending on which conveyor module is installed. For example, broom module 300 is mounted to connection points 104*a* and 104*b* when conveyor module 200 is used, and to connection points 104*b* and 104*c* when conveyor module 300 is used, as shown in FIGS. 1 and 2, respectively. Support arms 102 can also be utilized to hold equipment above the main broom 316 at equipment support location 120, shown in FIGS. 3-4. For example, a hydraulic power unit, oil coolers, and/or additional water storage tanks can be supported by arms 102.

In the non-limiting example shown, support structure 100 also includes slotted bracket 110, mounting bracket 118 and actuator 112. Mounting bracket 118, slotted bracket 110 and actuator 112 are for supporting and maneuvering the conveyor modules 200, 400 into the appropriate position with respect to the broom module 300 and the hopper 506. Also, mounting bracket 118 can be easily bolted and unbolted from the conveyor modules 200, 400 such that the conveyor modules may be easily changed out. It is also possible to use clips and retaining pins to hold mounting bracket 118 to the conveyor modules 200, 400 such that no tools are required for connection and disconnection. Many types of brackets and actuators are suitable for the above state purposes. In the particular embodiment shown, actuator 112 is a hydraulically powered linear actuator. However, one skilled in the art will appreciate that other types of actuators are possible and useful.

Referring to FIGS. 1 and 2, broom module 300 is shown. Broom module 300 is for removing debris away from a flat surface, such as a street, and towards the installed conveyor module. Many types of broom modules are suitable for this purpose. In the particular embodiment shown, broom module 300 is secured to support arms 102 via a pair of support members 302 and mounting brackets 306. To further secure broom module 300 to support arms 102, a pair of cross-members 304 are provided. Cross-members 304 connect mounting brackets 306 and support members 302 together. Also connected to each support member 302 is a pair of linkage arms 308 and 310. Linkage arm 308 is for supporting a dirt shoe 312 while linkage arm 310 is for supporting a main broom 316. Support member 302 is also shown as being connected to an actuator 322. As shown, actuator 322 is also connected to linkage arm 310 and is for changing the position of the broom 316 relative to the surface to be cleaned. As shown, actuator 322 is a hydraulic powered linear actuator, but other types of actuators known in the art are suitable as well. Also connected to linkage arm 310 is main broom 316 and actuator 324. Actuator 324 is for imparting a rotation to broom 316 such that the broom can move debris towards the conveyor modules 200, 400. As shown, actuator 324 is a hydraulic powered rotary actuator, but other types of actuators known in the art are suitable as well.

Broom module 300 is also shown as including main broom guard 320 and rear shield 318. These components are for ensuring that debris is effectively captured and moved from the street to the conveyor modules 200, 400. Main broom guard 320 is connected to brackets 306 while rear shield 318 is connected to cross-member 314 which spans the dirt shoes 312.

As shown in FIG. 1, first conveyor module 200 is a belt type conveyor 201 and includes a plurality of projecting paddles 202 that extend from a continuous, flexible conveyor belt 204. The conveyor belt 204 may be made of an elastomeric material or from a plurality of panels pivotally linked together. The conveyor belt 204 extends around a first roller (not shown) positioned in the first area 512 and a second roller (not shown) positioned at the second area 154. To help ensure that debris is retained onto the conveyor belt 204, and to add structural support for the rollers and conveyor belt 204, side portions 206 are provided on each side of the conveyor belt 204. On one of the side portions 206, an actuator 208 is mounted to rotate the conveyor belt 204 via coupling 214 in a direction 212 about the rollers. As shown, actuator 208 is a hydraulic powered rotary actuator, but other types of actuators can be used. To transfer debris from the main broom 316 to the hopper 506, the first conveyor module 200 is mounted to the support structure 100 which in turn is mounted to the vehicle chassis 502. Rollers 114, connected to lower support 120, are also provided on each side of the conveyor to support side portions 206. When so mounted, conveyor module 200 extends between the first area 512 proximate the main broom 316 and the second area 514 that accesses the internal volume of the hopper 506. As stated previously, when first conveyor module 200 is mounted to support structure 100, broom module 300 is connected to the support structure 100 at connection points 104*a*, 104*b*. These connection points allows for the main broom 316 to be placed at an ideal distance from the conveyor belt 204 for transferring debris from the broom 316 to the belt 204. The angle of the conveyor belt 204 to the surface to be cleaned 516, in the exemplary embodiment shown, is about 45 to 50 degrees although other angles are suitable.

Figure 3:
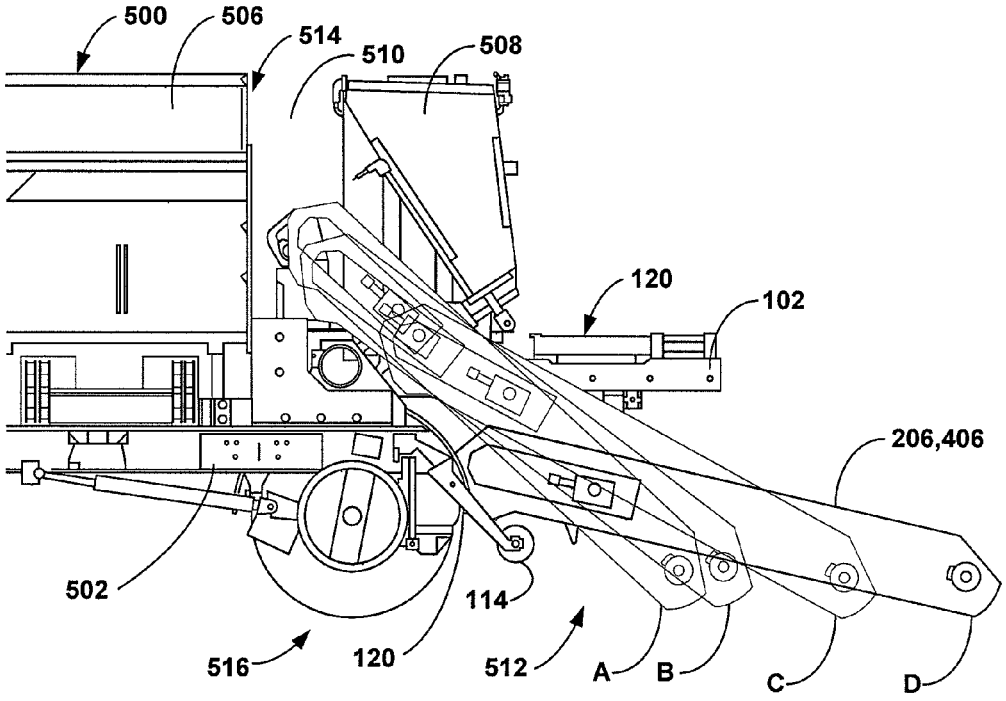
FIG. 3 is a side view of a street sweeping vehicle suitable for accepting the conveyor modules of FIGS. 1 and 2.
Figure 5:
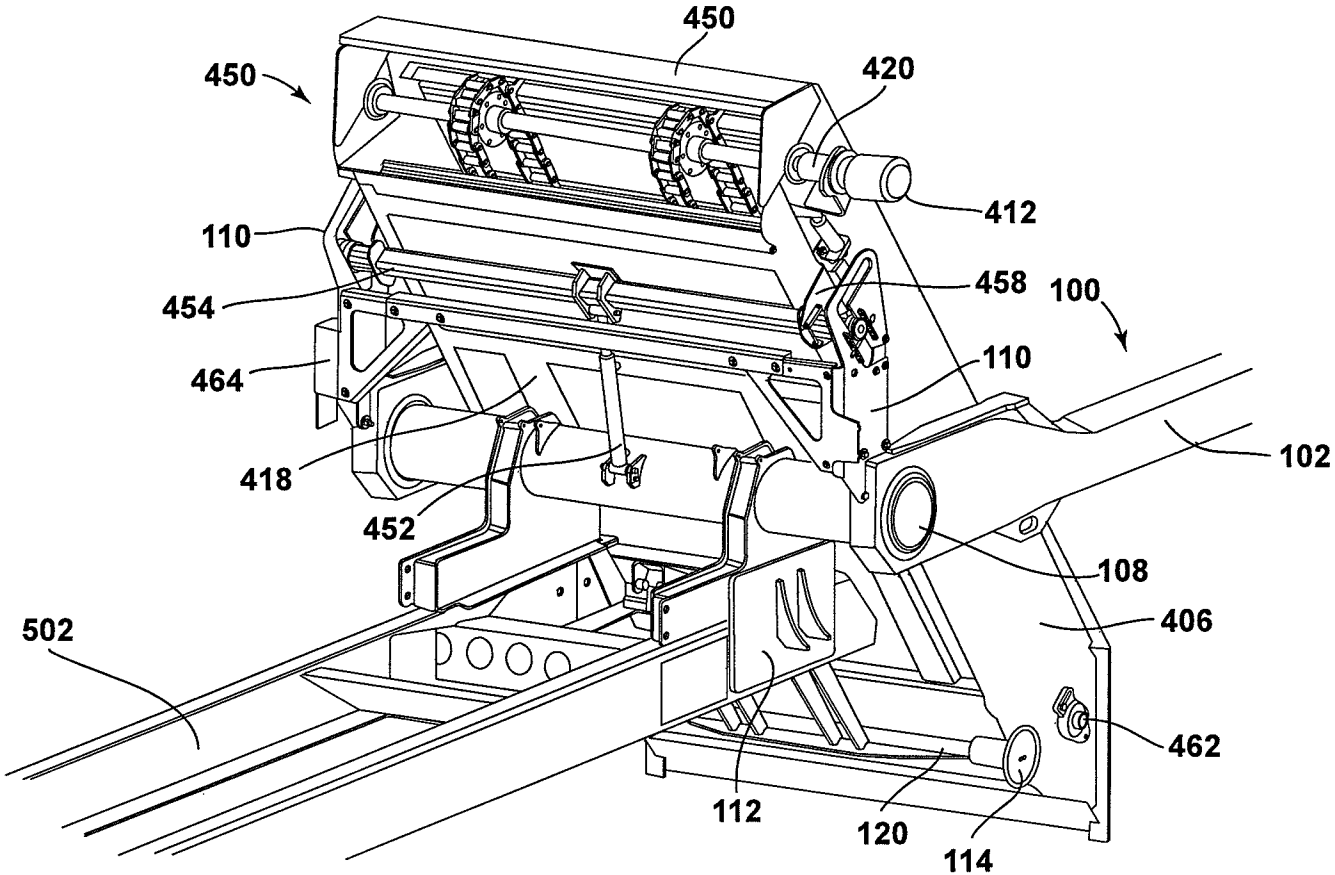
FIG. 5 is a rear perspective view of a third embodiment of a conveyor module.
Figure 6:
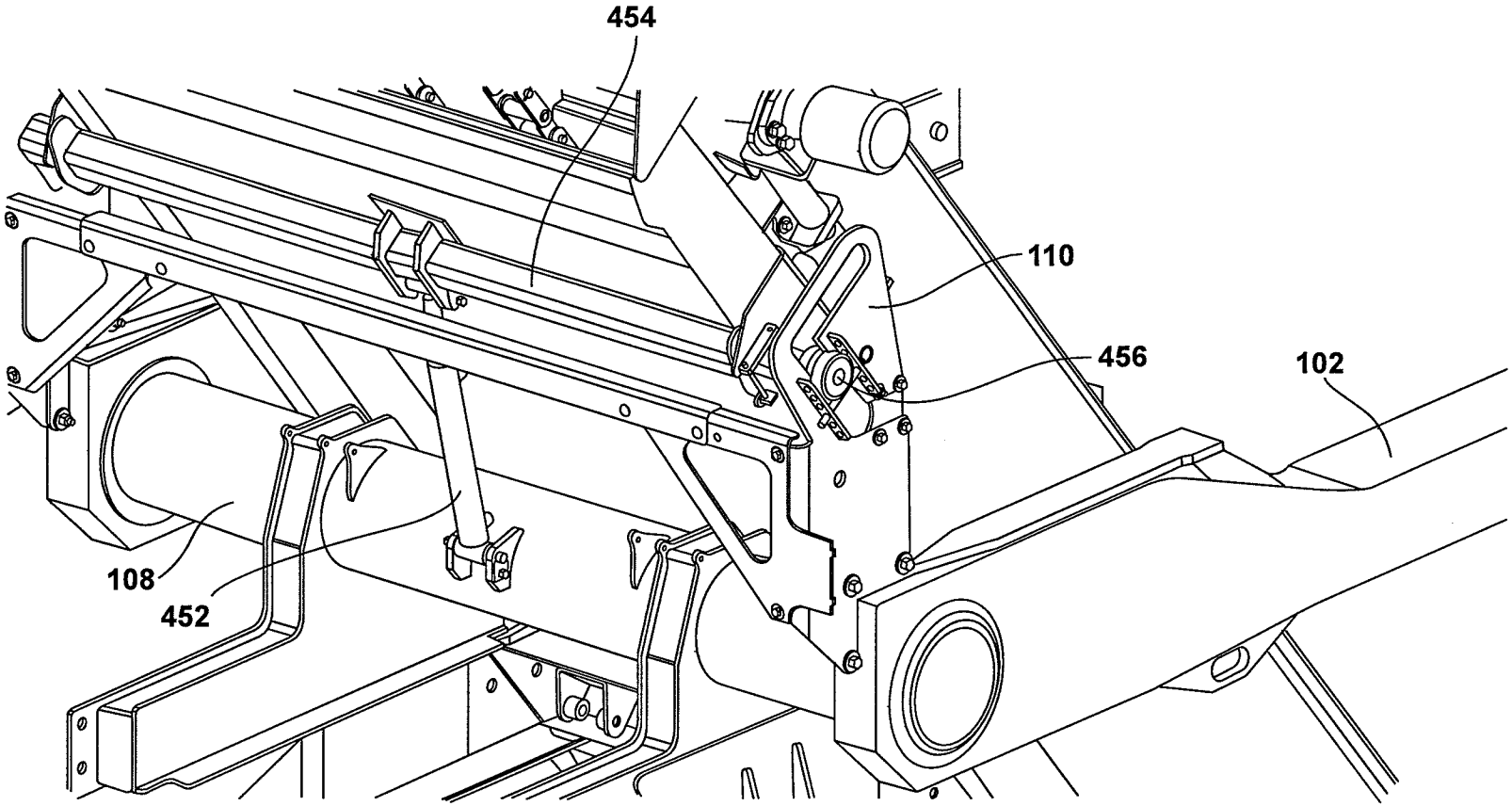
FIG. 6 is an enlarged view of the conveyor module view of FIG. 5.
Figure 7:
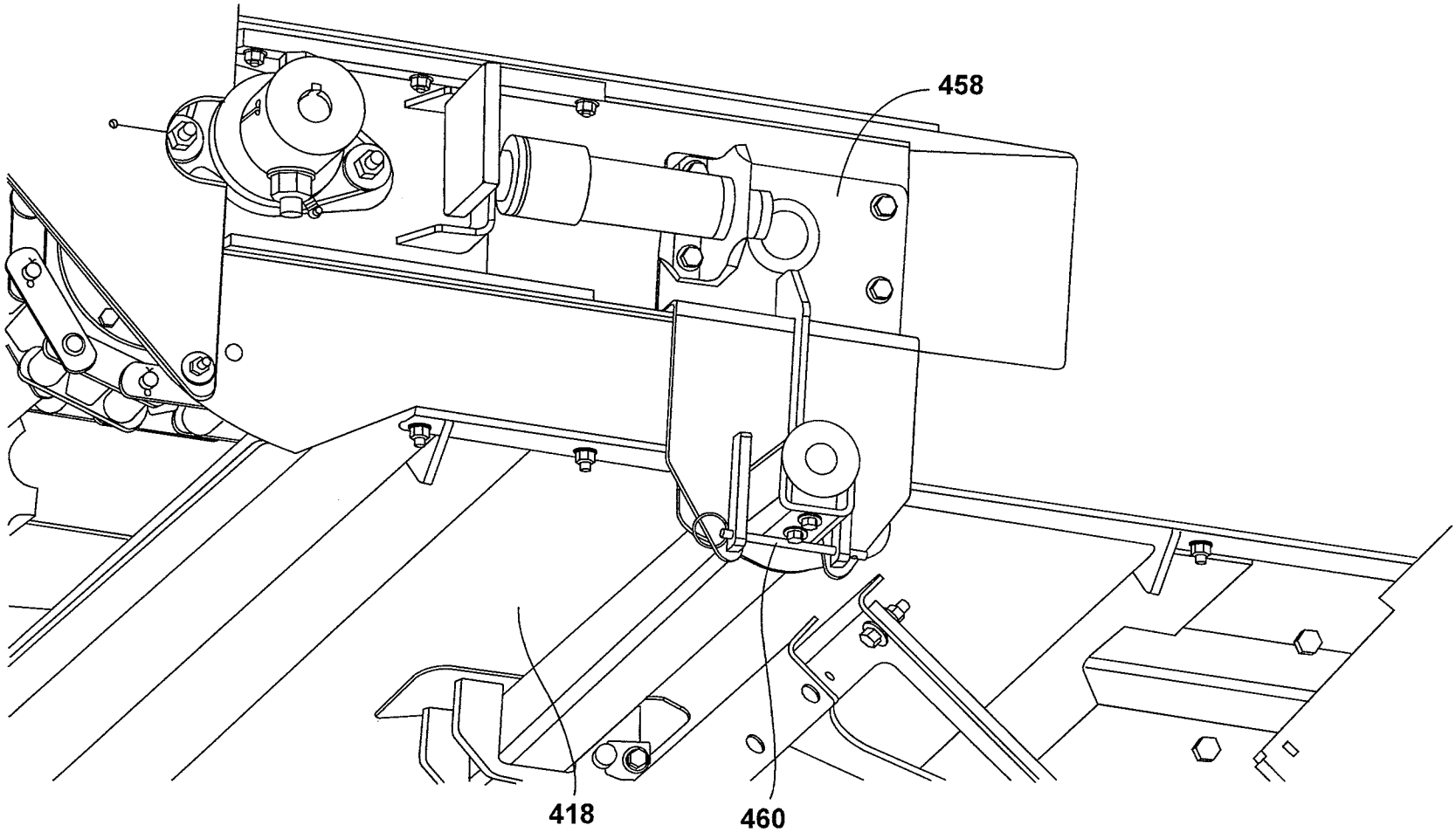
FIG. 7 is a side view of the conveyor module of FIG. 5.
Figure 8:
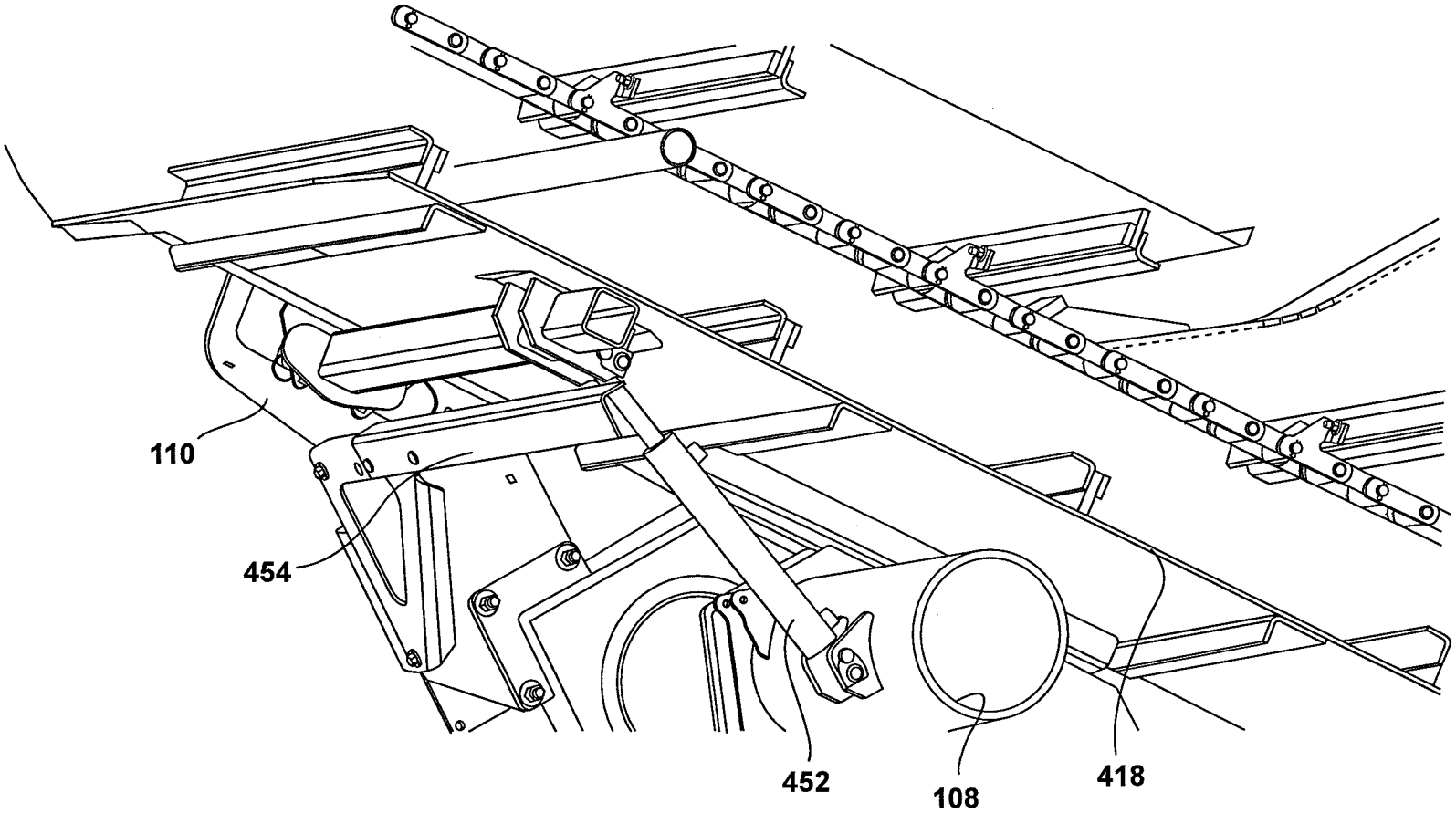
FIG. 8 is a cut-away side view of the conveyor module of FIG. 7.
Figure 9:
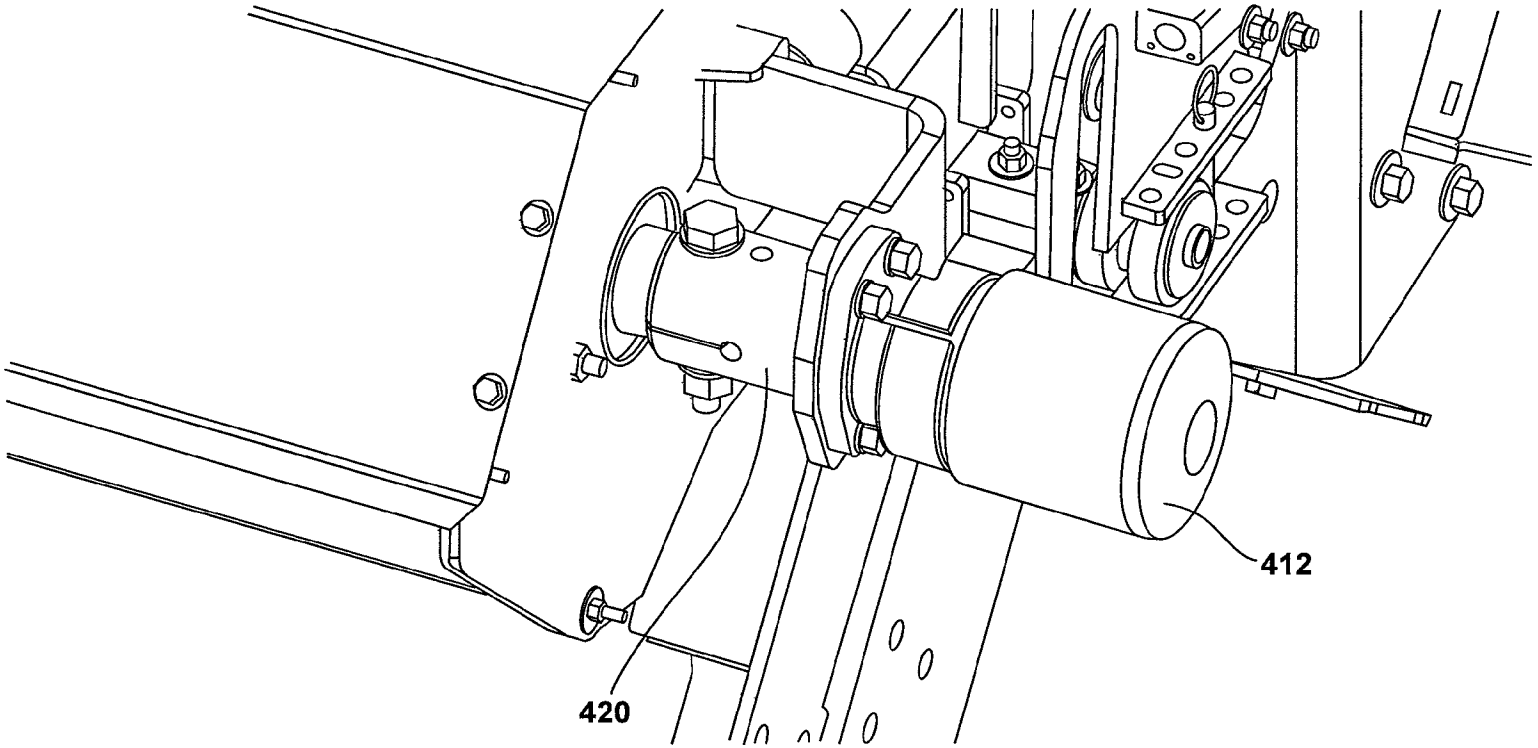
FIG. 9 is an enlarged view of the conveyor module of FIG. 5.
Figure 10:
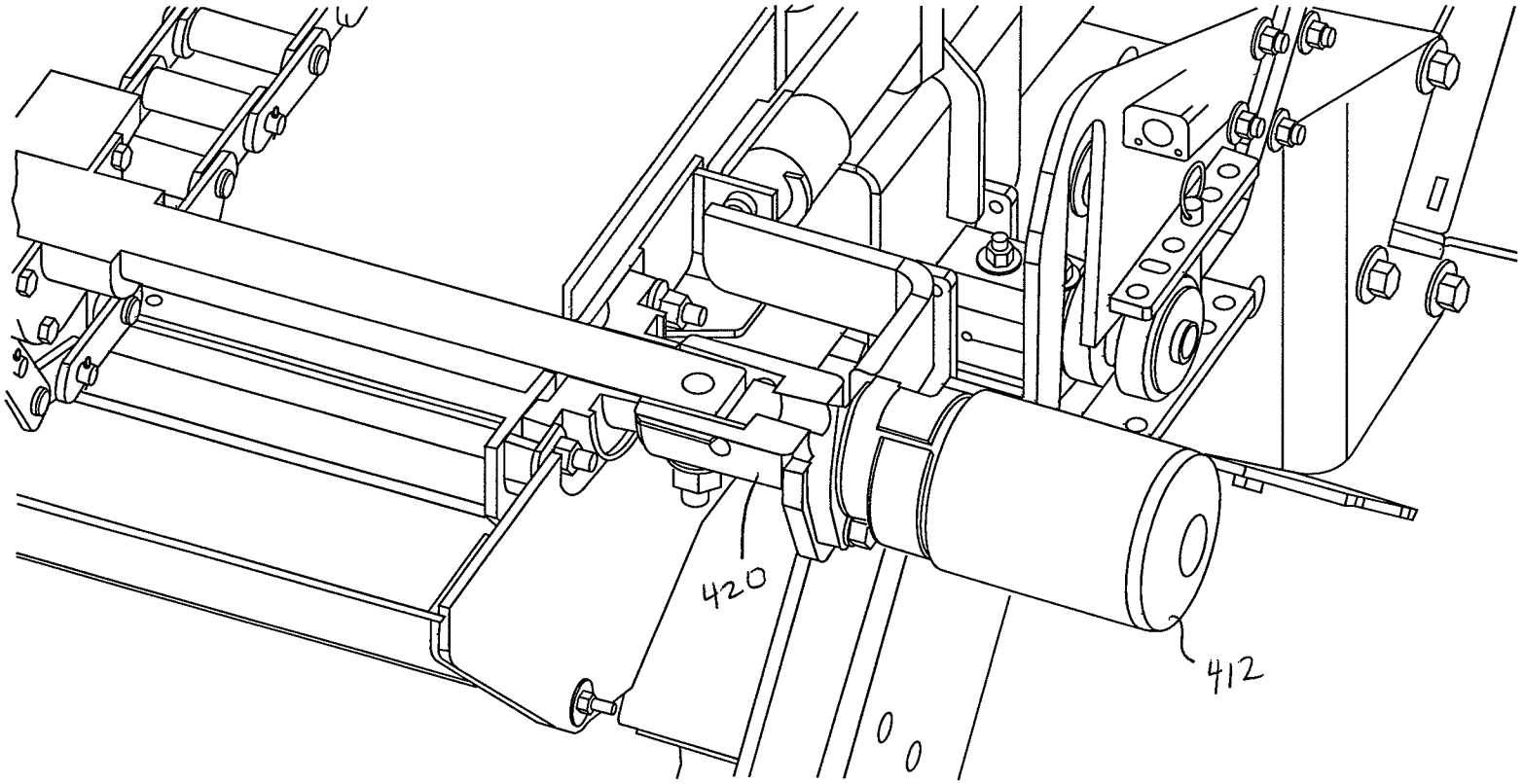
FIG. 10 is a cut-away view of the view shown in FIG. 9.
Figure 11:
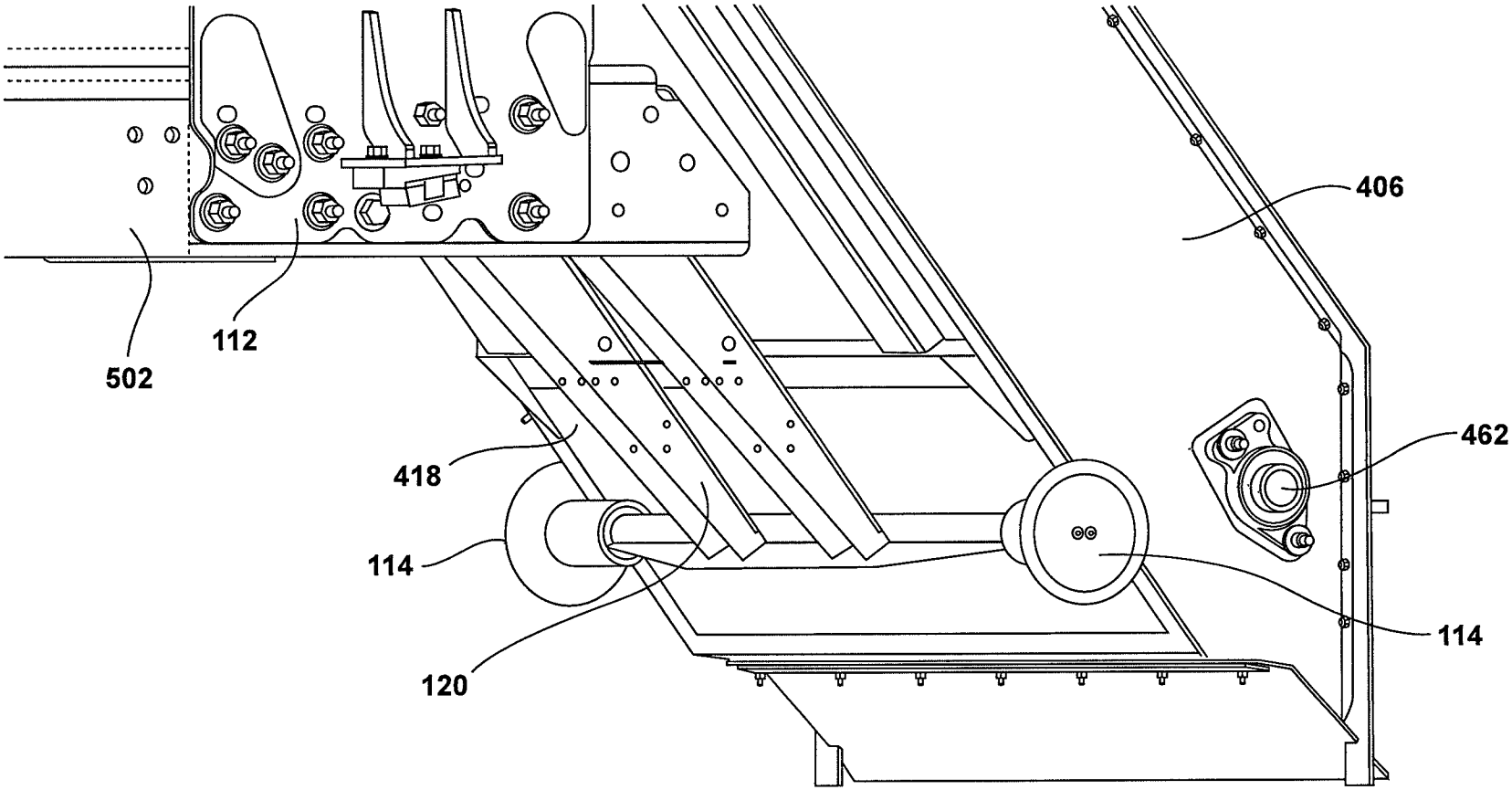
FIG. 11 is a rear perspective view of the conveyor module of FIG. 5.
Figure 12:
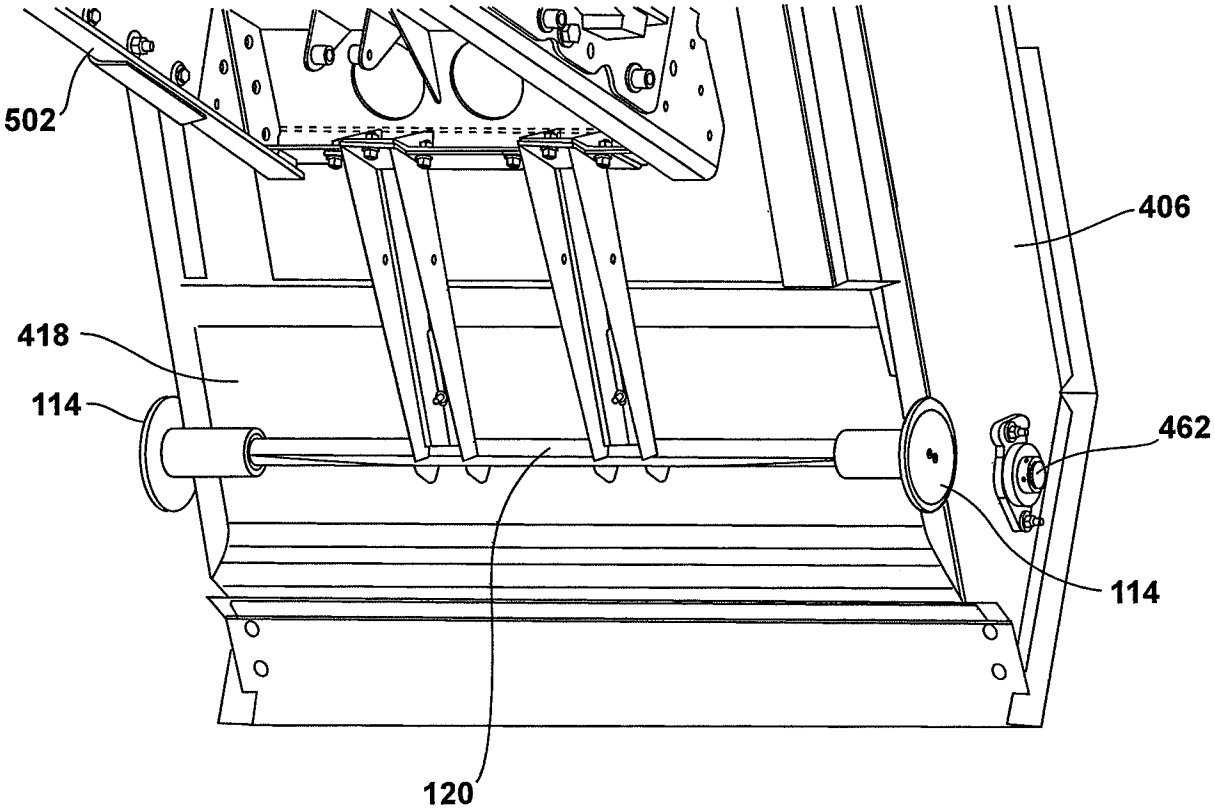
FIG. 12 is an enlarged view of the conveyor module view of FIG. 11.
Figure 13:
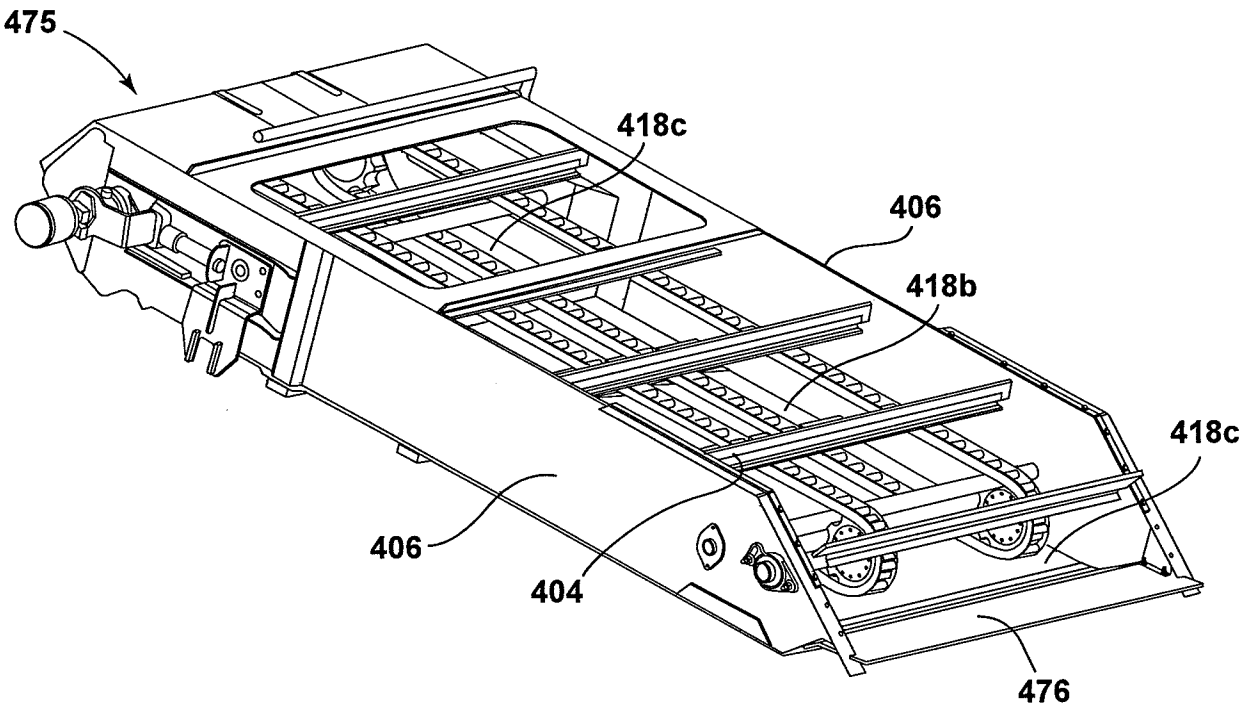
FIG. 13 shows a top perspective view of a fourth embodiment of a conveyor module.
Figure 14:
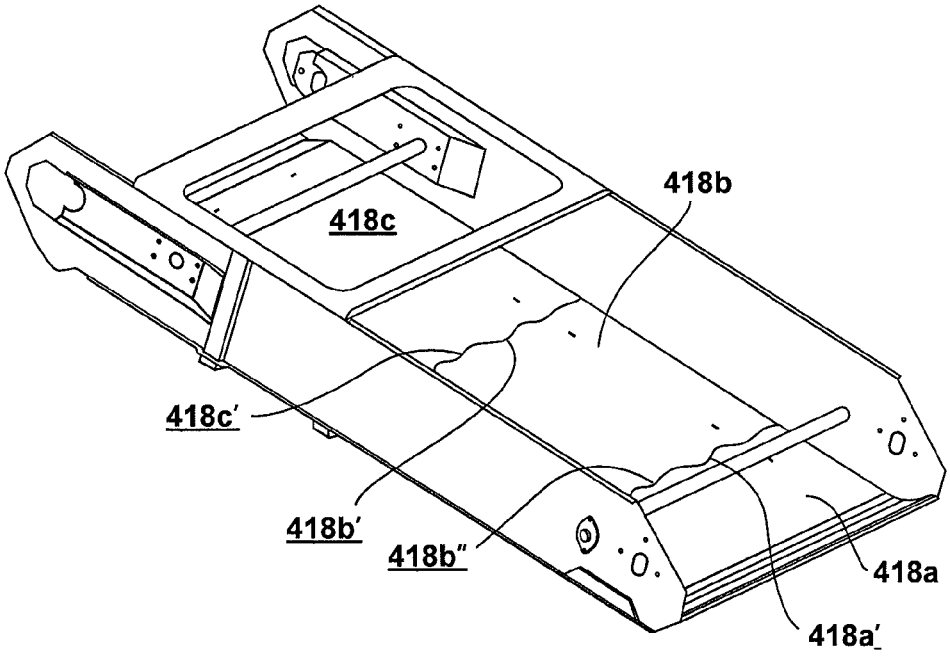
FIG. 14 is a top perspective view of the conveyor view of FIG. 13, but with certain components removed.
Figure 15:
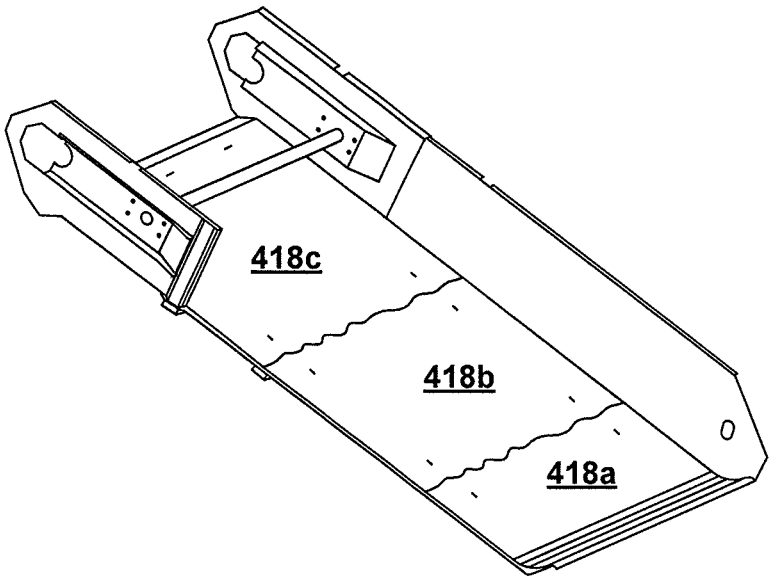
FIG. 15 is a top perspective view of the conveyor view of FIG. 14, but with a portion of the conveyor side hidden.
Figure 16:
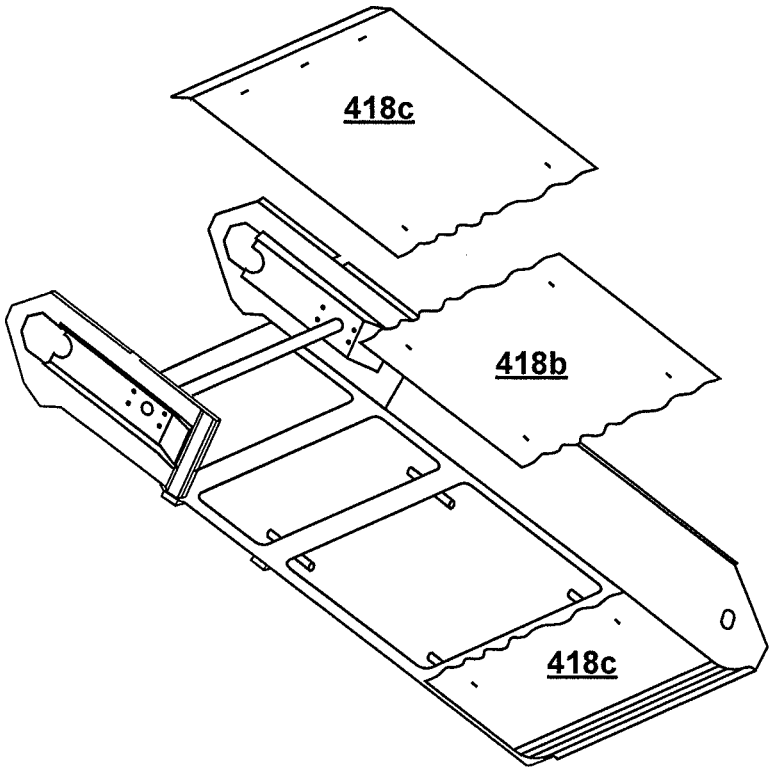
FIG. 16 is a top perspective view of the conveyor view of FIG. 14, but with two wear plates removed.
Figure 20:
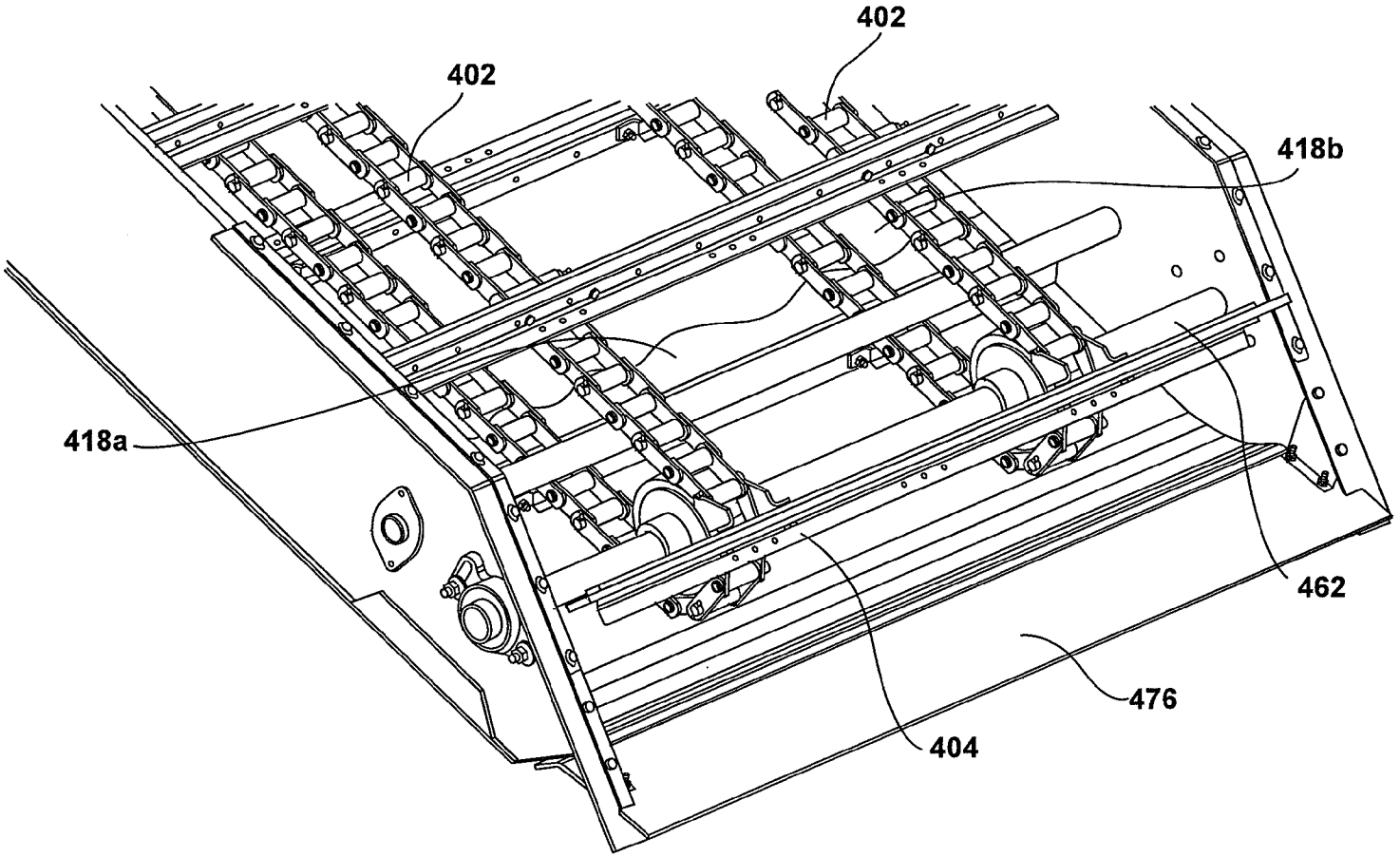
FIG. 20 is a top front perspective view of a portion of the conveyor of FIG. 13.
Figure 21:
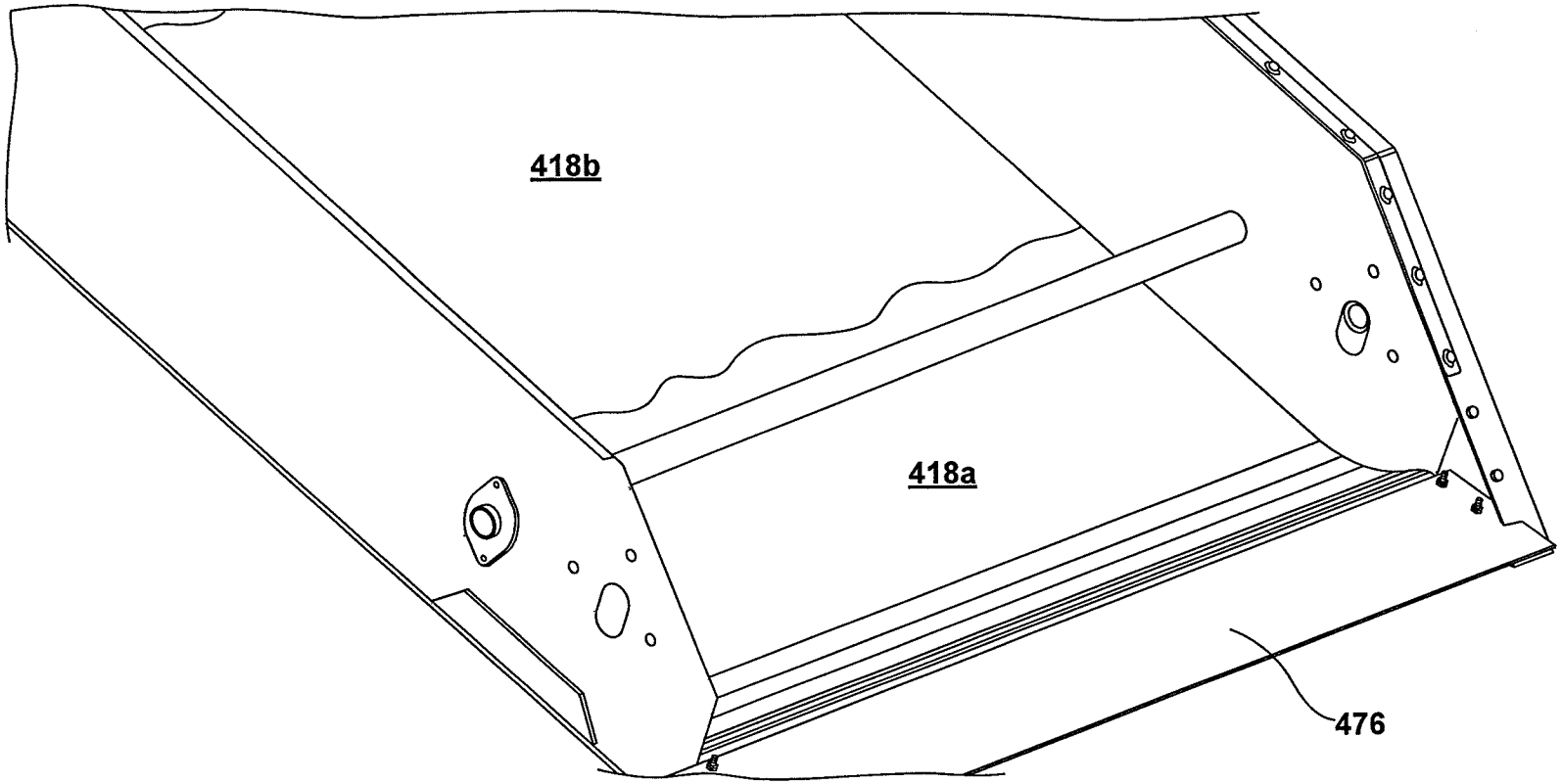
FIG. 21 is a top front perspective view of the conveyor view of FIG. 20, but with certain components removed.
Figure 22:
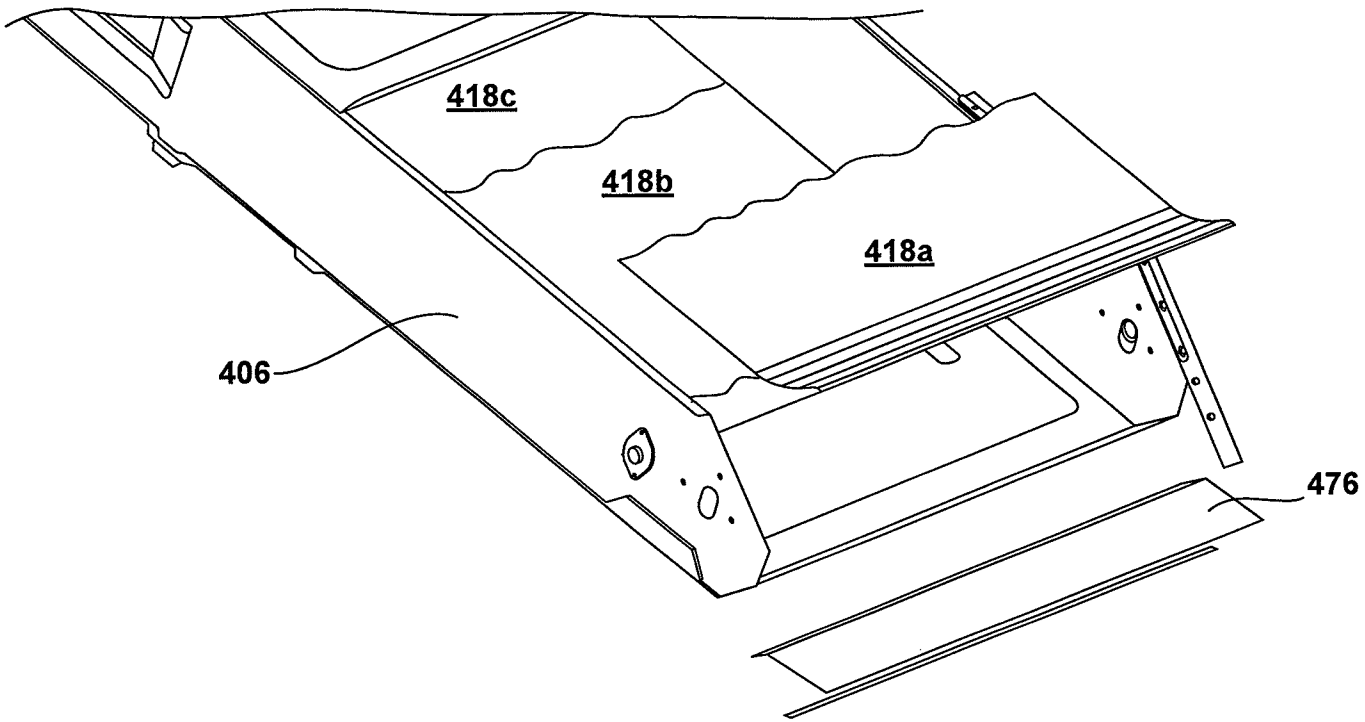
FIG. 22 is a top front perspective view of the conveyor view of FIG. 20, but with a wear plate removed.

As shown in FIG. 2, second conveyor module 400 is a squeegee type conveyor 401 and includes a plurality of projecting paddles 404 that attach to a pair of continuous chains or belts 402. The conveyor paddles 404 may be made of an elastomeric material. The conveyor chains or belts 402 extend around a first roller (see 462 on FIGS. 5 and 20) positioned in the first area 512 and a second roller 408 positioned at the second area 154. To help ensure that debris is retained onto the paddles 404, and to add structural support for the rollers, side portions 406 are provided on each side of the conveyor paddles 404. Side portions 406 are connected to wear plate 418 against which paddles 404 slide to transport debris to the hopper 506 (FIG. 3). On one of the side portions 406, an actuator 412 is mounted to rotate the conveyor belts or chains 402 via coupling 420 and cogs 410 in a direction 414 about the rollers. As shown, actuator 412 is a hydraulic powered rotary actuator, but other types of actuators can be used. To transfer debris from the main broom 316 to the hopper 506, the second conveyor module 400 is mounted to the support structure 100 which in turn is mounted to the vehicle chassis 502. Rollers 114 are also provided on each side of the conveyor to support side portions 406. When so mounted, conveyor module 400 extends between the first area 512 proximate the main broom 316 and the second area 514 that accesses the internal volume of the hopper 506.

As stated previously, when second conveyor module 400 is mounted to support structure 100, broom module 300 is connected to the support structure 100 at connection points 104*b*, 104*c*. These connection points allow for the main broom 316 to be positioned an ideal distance from the wear plate 418 of the conveyor module 400. The angle of the wear plate 418 to the surface to be cleaned 516, in the exemplary embodiment shown, is about 45 to 50 degrees. In comparison to the conveyor belt type module 201, the squeegee type module 401 must be spaced further away from the main broom in order to maintain a distance between the main broom 316 and the wear plate 418 that is similar to that between the main broom 316 and the conveyor belt 204. By providing multiple connections points 104*a*, 104*b*, 104*c* on support structure 100, it is possible to easily accommodate either type (belt 201 or squeegee 401) of conveyor module.

Figure 4:
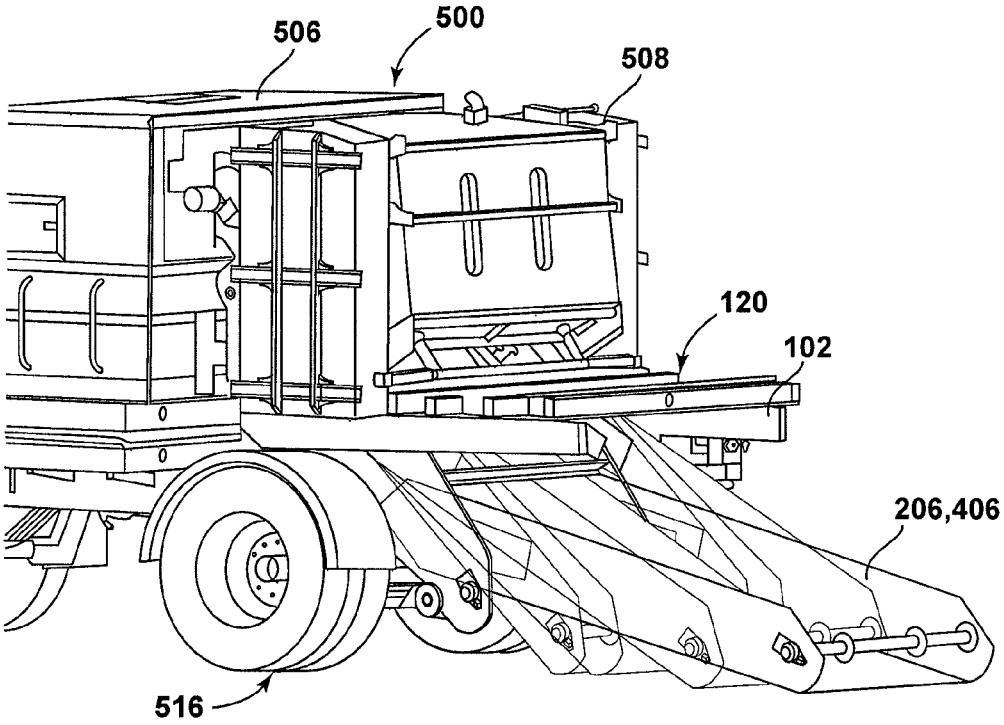
FIG. 4 is a rear perspective of the street sweeping vehicle shown in FIG. 3.

As shown in FIGS. 3 and 4, a conveyor passageway 510 is disposed through the street sweeper 100 extending between the first area 512 and the second area 514 to accommodate either one of the conveyor modules 200, 400. In the particular embodiment shown, passageway 510 is also disposed between hopper 506 and water tank 508. Passageway 510 provides a clearance through which the conveyor module 200, 400 can extend. Preferably, the conveyor module 200, 400 and conveyor passageway 510 are arranged so that the conveyor module 200, 400 extends at an angle through the street sweeper 100 with respect to the surface 516 on which the street sweeper is supported. Also preferably, to maximize its capacity, the conveyor module 200, 400 and conveyor passageway 510 substantially correspond dimensionally to the width of the hopper 506. Furthermore, the conveyor passageway 510 is of a sufficient dimension to provide clearance for paddles 404, and a typical debris load carried by paddles 202, 204 extending from the conveyor belt 204, 402, respectively.

Because the passageway 510 and the attachment points for the conveyor modules 200, 400 are common, the two conveyor modules 200, 400 can be interchanged at will. Referring to FIG. 3, it is shown how the conveyor modules, after the removal of broom module 300, can be easily rotated into and out of position. To further illustrate this concept, the sides of the conveyor modules, either 206 or 406, are shown in FIG. 3 as rotating through various positions A, B, C and D wherein the modules will be rotated into position by rotating the conveyor module in a direction from position D towards position A, and out of position by rotating the conveyor module in a direction from position A towards portion D. With this functionality, a single street sweeping vehicle investment can be made with dual/multiple functionality in terms of conveyor technology.

Referring to FIGS. 5-12, a second embodiment of a squeegee-type conveyor module 450 is shown. This embodiment shares many of the same features as conveyor module 400, the description of which is incorporated for the second embodiment. Where features are the same between module 450 and module 400, numbering is the same. As stated previously, conveyor module 400 uses a pair of actuators 112 and a set of brackets 110, 118 to retain and maneuver the conveyor module 400. In contrast to this approach, which requires two actuators, conveyor module 450 is constructed using a single actuator 452 that is connected to cross-beam 108 and to an elevator lift beam 454. Support 462 is also present to add support to brackets 110. As can be appreciated, actuator 452 can be of any suitable type, although the shown embodiment is a linear, hydraulic powered actuator. Elevator lift beam 454 is connected at each end to slotted bracket 110 through the use of guide rollers 456. In this particular embodiment, the conveyor module 450 is connected to the support structure 100 by the use of a saddle bracket 458 and saddle retaining pin 460 on each side 406 of the conveyor module 450. This can be most easily seen at FIG. 7. This configuration allows the conveyor module 450 to be easily installed and removed from the vehicle 500 without the need for special tools whereby lift beam 454, actuator 452, bracket 110, and support 464 remain with the vehicle 500 and can accept a different type of conveyor module. It is specifically noted that these components are also completely compatible for a belt type conveyor that has been configured with brackets 458 in the same manner as for conveyor 450.

The above are example principles that allow for conveyor modules of differing types to be easily utilized with a single vehicle investment. The above described interchangeability also allows for the conveyor components to be serviced in a more appropriate location than beneath the vehicle 500 where such functions are more typically performed. As such, downtime can be reduced while increasing safety at the same time.

Figure 17:
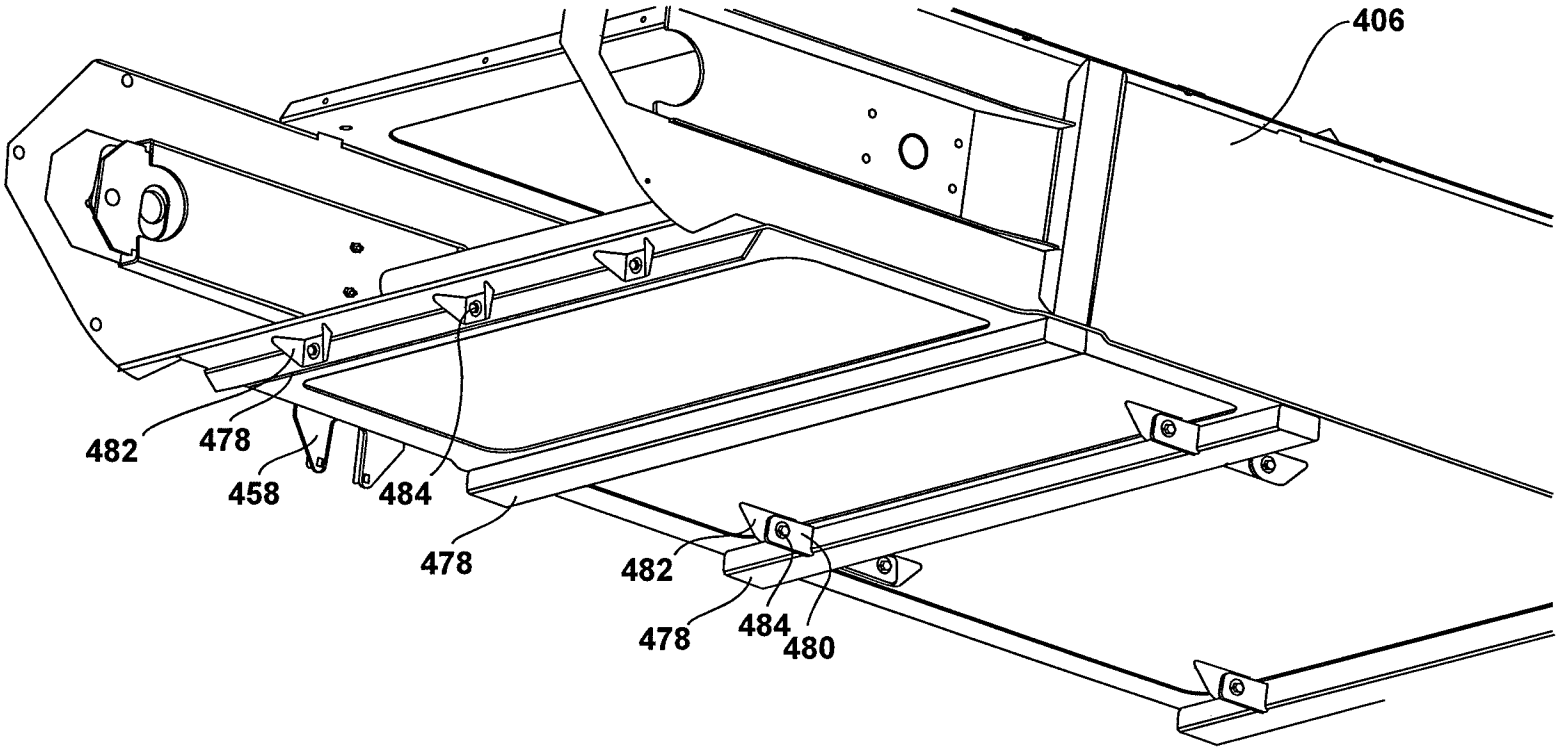
FIG. 17 is an under-side rear perspective view of the conveyor of FIG. 13.
Figure 18:
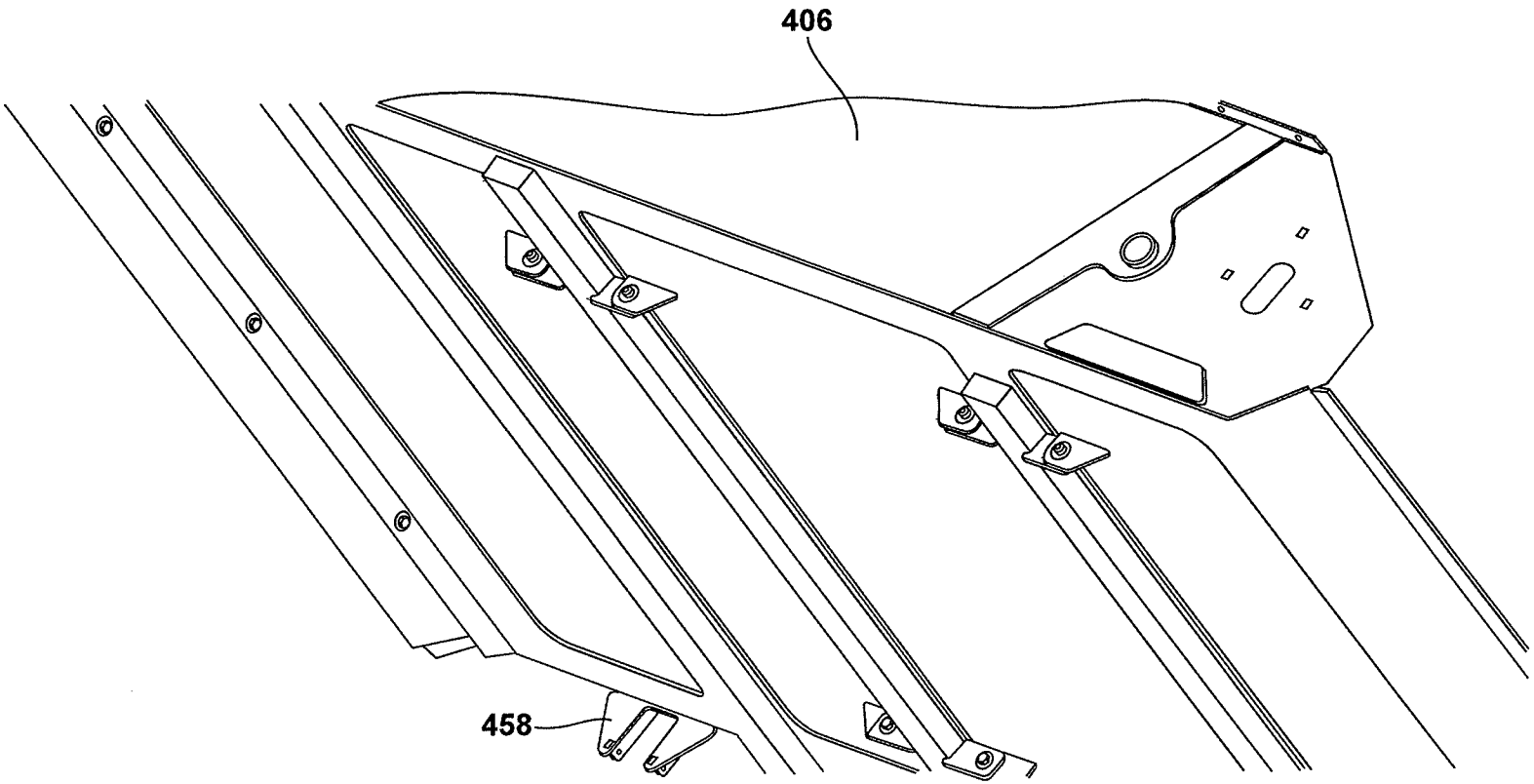
FIG. 18 is an under-side rear perspective view of the conveyor of FIG. 13.
Figure 19:
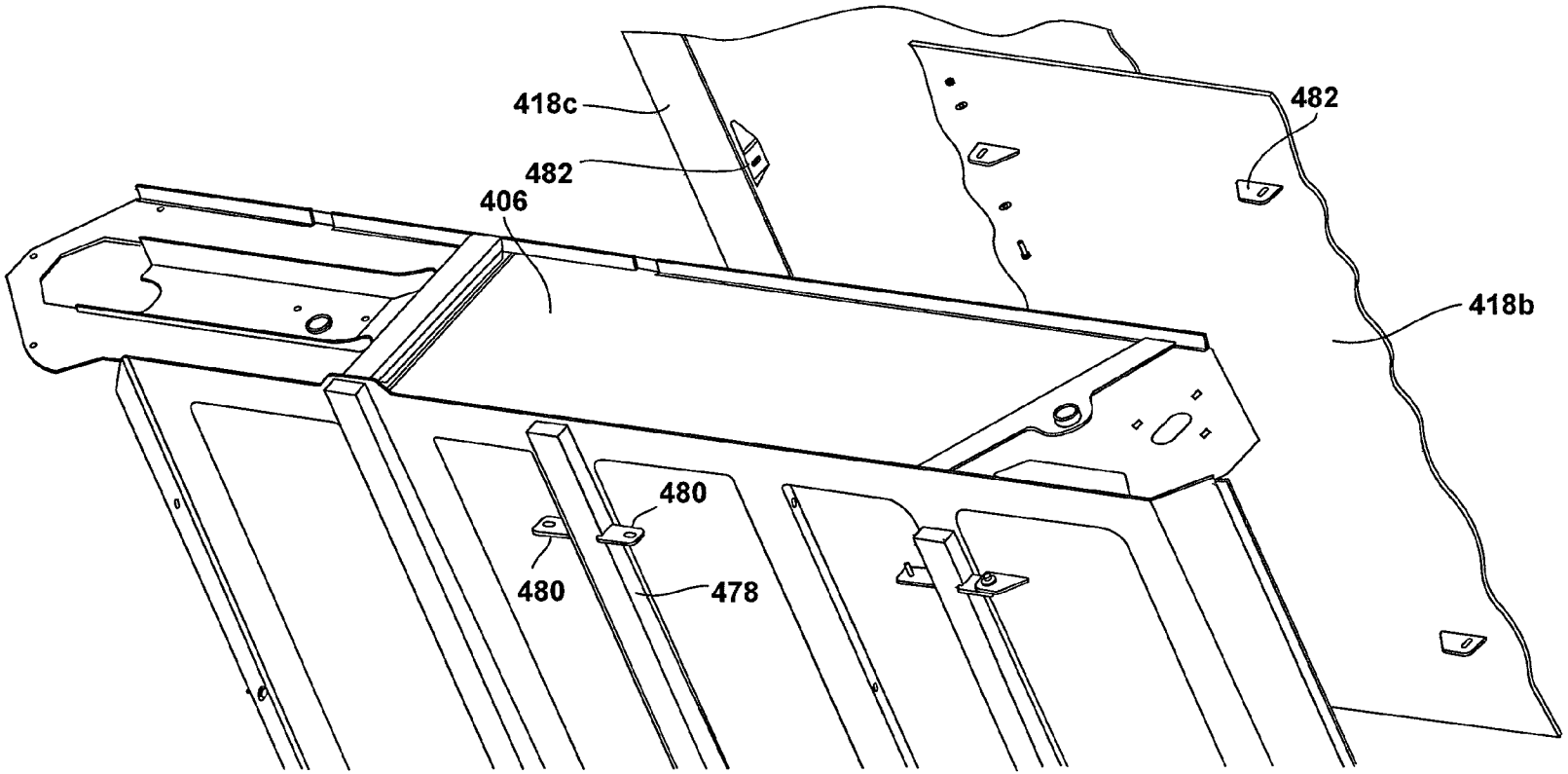
FIG. 19 is an under-side rear perspective view of the conveyor of FIG. 13, but with two wear plates removed.

Referring to FIGS. 13-22, a third embodiment of a squeegee-type conveyor module 475 is shown. This embodiment shares many of the same features as conveyor modules 400 and 450, the descriptions of which are incorporated for the third embodiment. Where features are the same between module 475 and modules 400 and/or 450, numbering is the same. Module 475 includes three separate wear plates 418*a*, 418*b*, 418*c* and a front edge 476. Each of the three separate wear plates 418 is supported by the conveyor module 475 by cross-supports 478. Some of the cross-supports have tabs 480 for mechanically securing corresponding tabs 482 on the wear plates 418 via fasteners 484. It is also noted that the tabs 482 can be fastened directly to the cross-supports 478, as shown in FIG. 17. Furthermore, and also as can be seen at FIG. 17, a cross-support 478 does not have to be mechanically fastened to any wear plate 418. This type of connection allows for all fasteners 484 to be located on the underneath side of the wear plates 418 and necessarily removes any potential interference or wear issues between the fasteners 418 and the paddles 404. Additionally, this configuration allows for the weight of the plates to be borne by the structure directly instead of through the fasteners, which here are connection bolts. In the embodiment shown, the fasteners 484 are required only to hold the position of the wear plates. It is noted that this type of connection system can be used with any of the above cited conveyor modules and is not limited to only module 475.

Still referring to FIGS. 13-22, wear plates 418*a*, 418*b*, 418*c* are shown as being further configured with at least one edge pattern. By the use of the term "edge pattern" it is meant that the edge is not simply a straight line. For example, wear plate 418*a* has an edge pattern 418*a*' that matches a complementary edge pattern 418*b*' of wear plate 418*b*. Wear plate 418*b* also has an edge pattern 418*b*" that matches a complementary edge pattern 418*a*' of wear plate 418*a*. It can also be seen that the wear plates are of different sizes as well. Having multiple wear plates allows for individual plates to be replaced as they become worn rather than requiring the replacement of a unit that is the entire length of the conveyor module. Additionally, these smaller plates are more easily handled by service personnel. The edge pattern can help to identify how the wear plates should be positioned and oriented within the module as well. To serve this purpose, the edge patterns can be regular, irregular, repetitive, and/or non-repetitive, so long as the edge patterns for wear plate 418*a* and 418*c* do not match. As importantly, the uneven interface of the edge patterns shown in the drawings helps to keep the debris flight from catching on the lip of adjacent wear plates, prevents jams, evenly distributes wear across the total surface and quiets the operation of the conveyor modules. As such, the shown wear plates and edge patterns provide a significant advantage over systems in which a single wear plate is used, or where multiple where plates might be used that do not have an edge pattern.

A method of using a street sweeping vehicle using the above materials should now be apparent. The method includes providing a vehicle chassis, a hopper, a conveyor support structure mounted to the vehicle chassis; and a broom assembly mounted to the conveyor support structure. Next, there is a step of interchangeably mounting one of a first and a second conveyor module to the conveyor support structure. By the term "interchangeably mounting", it is meant that the conveyor support structure can have mounted to it both the first conveyor module and the second conveyor module, although they cannot be mounted at the same time to the conveyor support structure, but one can be removed and replace with the other without destruction or overhaul or rebuilding or repairing of the equipment. The first conveyor is a belt type conveyor and configured to transport debris from the broom assembly to the hopper, and the second conveyor module is a squeegee type conveyor.

The method further includes operably using the mounted one of the first and second conveyor modules, and then removing the mounted one and operably using the other of the first and second conveyor modules.

The above examples are principles. Many embodiments can be made.

I claim:

1. A street sweeping vehicle comprising:

a. a vehicle chassis;

b. a hopper;

c. a conveyor support structure mounted to the vehicle chassis;

d. a broom assembly mounted to the conveyor support structure;

e. a first conveyor module mountable to the conveyor support structure, the first conveyor being a belt type conveyor and configured to transport debris from the broom assembly to the hopper; and f. a second conveyor module mountable to the vehicle structure, the second conveyor being a squeegee type conveyor that is interchangeable with the first conveyor module and being configured to transport debris from the broom assembly to the hopper.

2. A street sweeping vehicle according to claim 1, wherein the conveyor support structure includes multiple mounting locations for the broom assembly to accommodate the first and second conveyors.

* * * * *